US008398383B2

(12) United States Patent
Klabunde et al.

(10) Patent No.: US 8,398,383 B2
(45) Date of Patent: Mar. 19, 2013

(54) FOIL SHIELD FOR A VACUUM PUMP WITH A HIGH-SPEED ROTOR

(75) Inventors: Frank Klabunde, Asslar (DE); Tobias Stoll, Angelburg-Goennern (DE)

(73) Assignee: Pfeiffer Vacuum GmbH, Asslar (DE)

( * ) Notice: Subject to any disclaimer, the term of this patent is extended or adjusted under 35 U.S.C. 154(b) by 1972 days.

(21) Appl. No.: 11/274,799

(22) Filed: Nov. 14, 2005

(65) Prior Publication Data

US 2006/0110271 A1 May 25, 2006

(30) Foreign Application Priority Data

Nov. 24, 2004 (DE) ..... 10 2004 056 512

(51) Int. Cl.
*F04B 35/04* (2006.01)

(52) U.S. Cl. ..... 417/423.4

(58) Field of Classification Search ..... 417/423.4
See application file for complete search history.

(56) References Cited

U.S. PATENT DOCUMENTS

| | | | | |
|---|---|---|---|---|
| 3,278,857 | A | 10/1966 | Peters | |
| 3,512,946 | A * | 5/1970 | Hutkin | 428/612 |
| 3,714,483 | A * | 1/1973 | Nurnberg et al. | 310/256 |
| 4,647,714 | A * | 3/1987 | Goto | 174/36 |
| 5,580,429 | A * | 12/1996 | Chan et al. | 204/192.38 |

FOREIGN PATENT DOCUMENTS

| | | | |
|---|---|---|---|
| DE | 9652331 | | 5/1998 |
| EP | 1241926 | | 3/2002 |
| EP | 1270949 | | 1/2003 |
| JP | EP1270949 | * | 1/2003 |

* cited by examiner

*Primary Examiner* — Charles Freay
*Assistant Examiner* — Christopher Bobish
(74) *Attorney, Agent, or Firm* — Abelman, Frayne & Schwab

(57) ABSTRACT

A foil shield for covering at least one opening of a suction flange of a vacuum pump includes at least one member formed of a material having a relative permeability $\mu_r$ greater than 1,000.

6 Claims, 2 Drawing Sheets

FOIL SHIELD FOR A VACUUM PUMP WITH A HIGH-SPEED ROTOR

BACKGROUND OF THE INVENTION

1. Field of the Invention

The present invention relates to a foil shield for use with a vacuum pump having a high speed rotor. The invention also relates to a vacuum pump with a foil shield.

2. Description of the Prior Art

Vacuum pumps with high-speed rotors are successfully used for generation of high and ultra-high vacuum. One of the most common types of vacuum pumps, which are used for generation of high and ultra-high vacuum, is turbomolecular pumps which are also called turbo pumps. In these pumps, rotor and stator discs, which are provided with blades, are arranged alternatively with each other, with the rotor having a rotation frequency between 10 $s^{-1}$ and 1000 $s^{-1}$ (revolutions per second). When these vacuum pumps are used in environments with high magnetic fields, eddy currents are generated in the rotor. The eddy currents lead to heating of the rotor and, thereby, to its linear extension. With a necessary small gap width of the vacuum pumps, the linear extension is critical and can result in a contact of the rotor with the stator. On the other hand, the eddy currents cause braking of the rotor and associated therewith a high power consumption of the drive.

Opposite is also problematic. The high-speed rotors are often magnetically supported, i.e., the rotor is supported by magnetic forces, without any mechanical contact. A magnetic field which is generated in a magnetic bearing is not limited to the bearing space during its spatial expansion. The magnetic field lines can emerge out of the suction opening of the pump and cause disturbances in apparatuses located in front of the suction opening. One of such apparatuses can be an electronic microscope in which the stray field of the magnetic bearing can lead to deflection of an electron ray and, thereby, to loss or reduction of its resolution. Because of ever greater sensitivity and the required better resolution, this ray deflection can be tolerated in a very small amount.

According to the state of the art, this problem is attempted to be solved by shielding the pump housing and the rotor shaft (z. Vakuum—Technik, 27, vol. 1, pp. 6-8, Vacuum-Technology).

Another solution is proposed in German patent number 3,531,942. The proposed solution lies in suppressing of eddy currents, with the rotor and its components being formed of a material with a specific resistance of $10^{-4}$ Ωm or more. A particularly recommended material is silicon nitride.

The solutions according to the state of the art have many drawbacks. The shielding of the housing produces unsatisfactory results. Additional shielding of the rotor shaft is technically difficult from the manufacturing point of view. The proposed material selection is extremely expensive and is not suitable for wide use with a large number of produced items.

Accordingly, an object of the invention is a significantly improved magnetic decoupling of the interior of a pump from its surrounding, without using expensive measures, so that solution remains cost-effective.

SUMMARY OF THE INVENTION

This and other objects of the present invention, which will become apparent hereinafter, are achieved by providing a foil shield for covering an opening of a suction flange of a vacuum pump and which has at least one member formed of a material having a relative permeability greater than 1,000.

The inventive foil shield, with an appropriate selection of a material the at least one member is formed of, serves not only for shielding of the pump in front of foreign bodies but simultaneously shields the pump from penetration of the magnetic field through the suction opening and prevents the stray fields, which can be produced by magnetic bearings, from emerging from the pump. Thereby, it becomes possible to circularly shield the high-speed rotor of the vacuum pump, together with the pump housing. This prevents formation of eddy currents in the rotor to a most possible extent.

The proposed measures permit to shield existing pump and also to adapt the pump to a site with a high magnetic field after the pump is produced. As it has already been discussed above, the inventive foil shield prevents emergence from the pump of stray fields generated by a magnetic bearing. Because a very small amount of material is necessary for covering the suction opening of the vacuum pump, the proposed solution is comparatively inexpensive, in particular, in comparison with formation of an entire rotor of a special material.

The effective magnetic separation of the interior of the vacuum pump from the vacuum chamber can be improved when the foil shield is additionally provided with a layer of an electroconductive material. The electroconductive layer increases the separation effect for dynamic, time-variable magnetic fields.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENT

Figure 1:
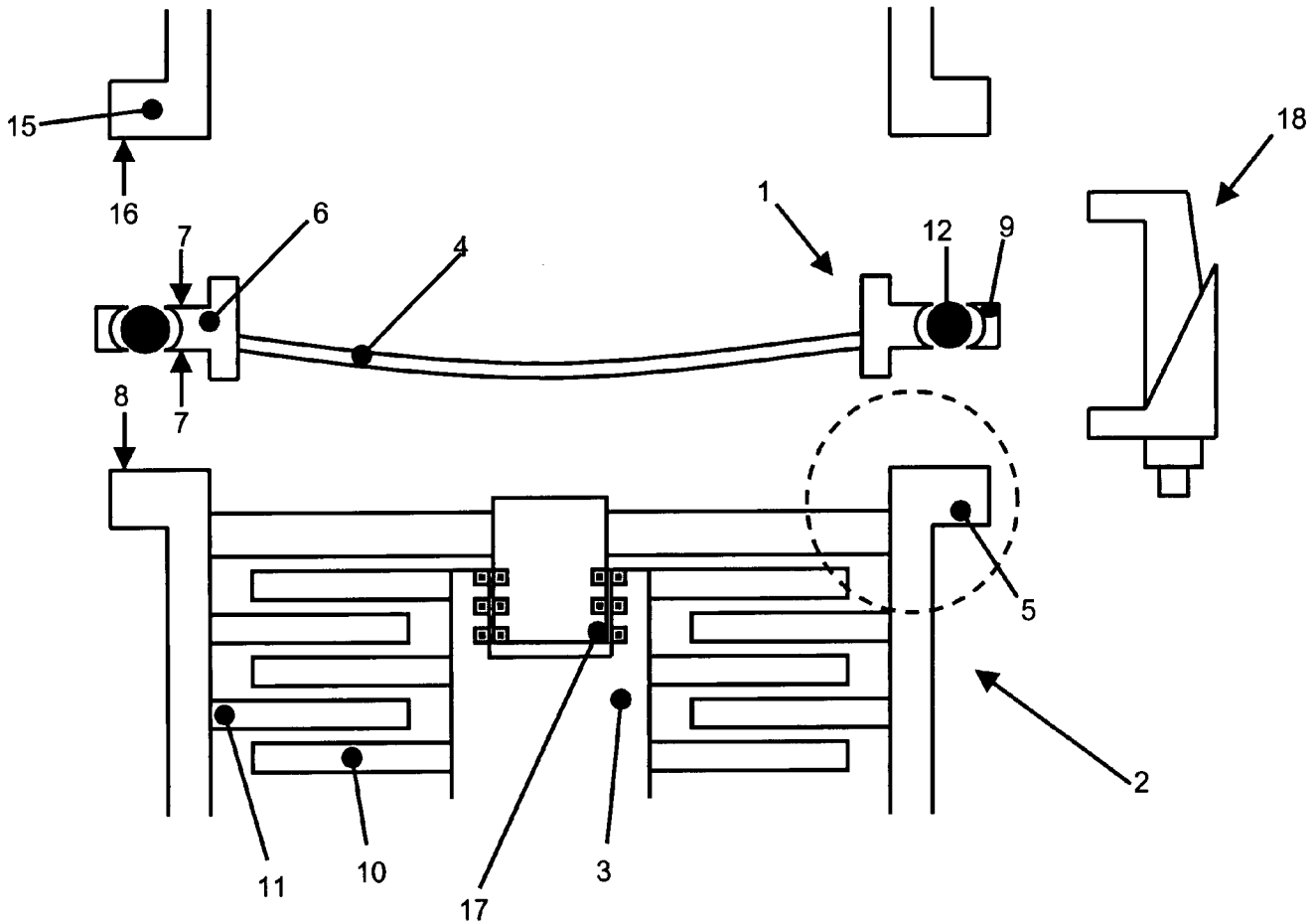
FIG. 1 a schematic view showing a flange of a vacuum chamber, a vacuum pump, a foil shield, and clamping screws.

FIG. 1 shows schematically a flange of a vacuum chamber, a vacuum pump, an inventive foil shield, and one of clamping screws necessary for the attachment of the components of the system. The foil shield 1 includes the following components: a centering ring 6 and a net-shaped member 4 that covers an opening of the suction flange 5 as soon as the foil shield is connected with the vacuum pump. The shield can be connected with the suction flange 5 of the vacuum pump 2. Inside of the vacuum pump 2, a high-speed rotor 3 is arranged. On the rotor 3, a plurality of vanes 10 is supported. The vanes 10 are arranged opposite vanes 11 supported in the pump housing. The rotor 3 is supported by a magnetic bearing formed of magnets 17. In the embodiment shown in the drawings, the magnetic bearing is formed as a passive magnetic bearing, though an active magnetic bearing can also be used. Rotation of the rotor 3 produces a pumping effect. The vacuum pump 2 and the foil shield 1 are connected with a flange 15, e.g., of a vacuum chamber and are secured therewith by suitable attachment means, e.g., by clamping screws 18. The foil shield 1 can be surrounded with an elastomeric ring 12 for sealing purposes. The elastomeric ring 12 can be supported by a support ring 9.

Figure 2:
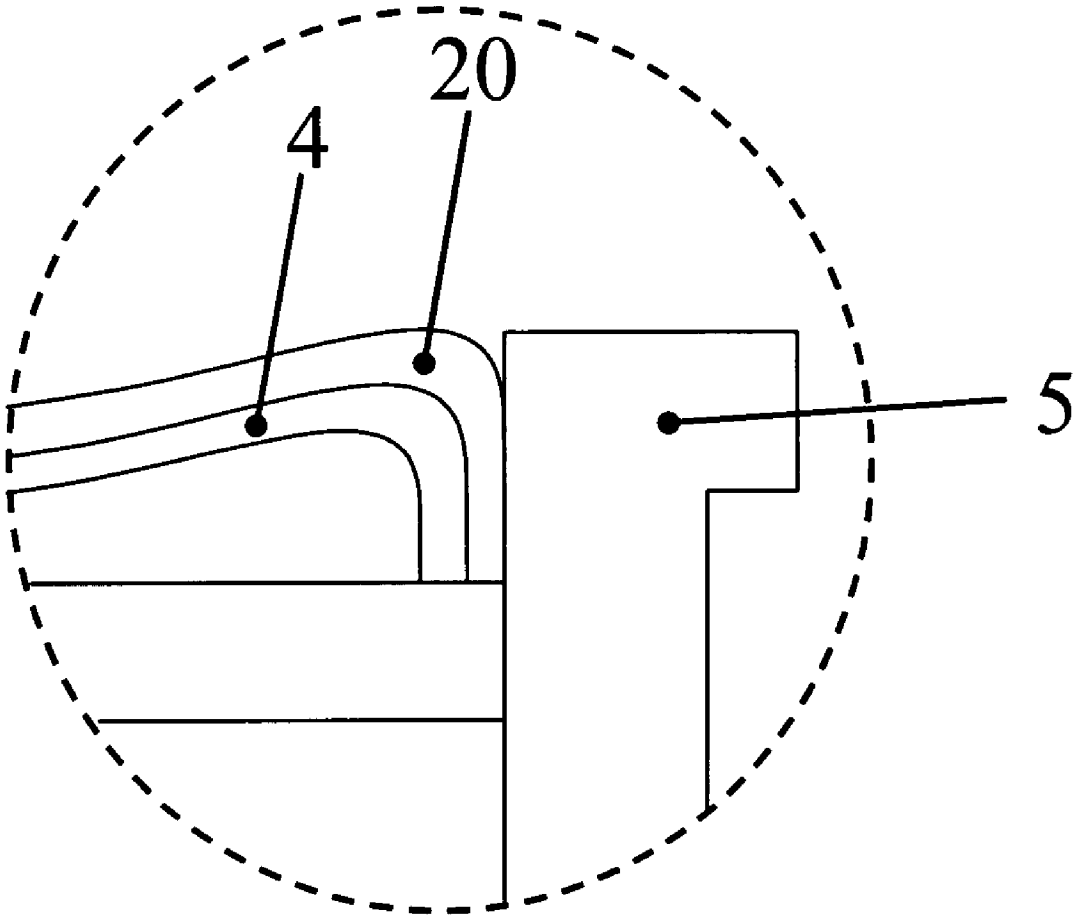
FIG. 2 a cutout view of a simple embodiment of the foil shield.

FIG. 2 shows a very simple embodiment of the foil shield 1 and, specifically, only the region in FIG. 1 shown with a dash line circle, namely the region in the vicinity of the flange 5 of the vacuum pump. The net-shaped member 4 is so formed that it is insertable in the opening of the vacuum pump 2, covering the opening. Such an arrangement reduces the number of necessary components and prevents a need in an additional space between the vacuum pump 2 and the vacuum chamber. The net-shaped member 4 has an electroconductive layer 20 formed, e.g., of copper. This insures a better separation of a magnetic field that changes with time (dynamic magnetic field). The shield is formed as a sandwich structure of Mu-Metal and copper foil. After these two layers are connected, holes are formed in the foil, whereby a net structure is produced.

The shielding characteristics against magnetic fields depends on the thickness of the material and its relative permeability $\mu_r$. In order to be able to keep the member 4 sufficiently thin (typically, several tenths of mm), according to the invention, a material having a high relative permeability $\mu_r$ is used. With a relative permeability $\mu_r$ of more than 1000, the member 4 can be formed thinner than with a material such as steel.

A further reduction of thickness of the member 4 can be achieved using a material with a relative permeability $\mu_r$ of more than 10,000.

According to an advantageous embodiment of the net-shaped member 4, it is formed of a material having a relative permeability $\mu_r$ of more than 25,000. Such a high permeability permits to form the net-shaped member 4 with a smaller axial thickness and to keep, thereby, conductance losses of the pumped-out gas low.

In one of the embodiments a metal, which is known under a trade name "Mu-metal" is used. The designation "Mu" means "impermeable for magnetic field." This metal is based on a nickel-iron alloy.

Other nickel-iron alloys can also be used, with content of nickel of at least 70% and content of iron of at least 10%.

According to an advantageous embodiment of the invention, the surfaces 7, 8 and 16, which come into a contact with each other upon connection of the foil shield with the vacuum pump 2, have a definite and constant friction coefficient. Therefore, it is possible to insure a reliable connection of the foil shield with the vacuum pump even with often mounting and dismounting of the shield. In addition the surfaces 7, 8, 16 can be provided with an appropriate coating having a definite and constant friction coefficient.

Molecular vacuum pumps (e.g., Holweck pumps) and special turbomolecular vacuum pumps have a very high rotational speed of the rotor at a small gap width. In these vacuum pumps, often, magnetic bearings are used. In these pump, use of the inventive foil shield proved to be particularly advantageous.

Though the present invention was shown and described with references to preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A foil shield for covering at least one opening of a suction flange of a vacuum pump, the foil shield comprising at least one member formed of a material having a relative permeability $\mu_r$greater than 1,000 and having a coating formed of an electroconductive material;

further comprising a centering ring, wherein associated surfaces of the centering ring, of the suction flange, and of a flange of a vacuum chamber, with which the vacuum pump is connected, which contact each other upon assembly, have each a coating having a definite and constant friction coefficient.

2. A foil shield according to claim 1, wherein the at least one member is formed of a material having a relative permeability $\mu_r$ of more than 10,000.

3. A foil shield according to claim 2, wherein the at least one member is formed of a material having a relatively permeability $\mu_r$ of more than 25,000.

4. A foil shield according to claim 1, wherein the at least one member is formed of an alloy material containing at least 70% of nickel and at least 10% of iron.

5. A foil shield according to claim 3, wherein the material is a magnetic field-impermeable material.

6. A foil shield according to claim 1, wherein associated surfaces of the centering ring, of the suction flange, and of a flange of a vacuum chamber, with which the vacuum pump is connected, which contact each other upon assembly, have a definite and constant friction coefficient.

* * * * *